US010065083B2

(12) United States Patent
Beach et al.

(10) Patent No.: US 10,065,083 B2
(45) **Date of Patent: *Sep. 4, 2018**

(54) GOLF CLUB HEAD

(71) Applicant: Taylor Made Golf Company, Inc., Carlsbad, CA (US)

(72) Inventors: Todd P. Beach, Encinitas, CA (US); Nathan T. Sargent, Oceanside, CA (US); Peter L. Larsen, San Marcos, CA (US); Kraig Alan Willett, Fallbrook, CA (US); Bing-Ling Chao, San Diego, CA (US); John Francis Lorentzen, El Cajon, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/862,438

(22) Filed: Sep. 23, 2015

(65) Prior Publication Data

US 2016/0008682 A1 Jan. 14, 2016

Related U.S. Application Data

(63) Continuation of application No. 12/589,804, filed on Oct. 27, 2009, now Pat. No. 9,162,115.

(51) Int. Cl.
*A63B 53/04* (2015.01)
*A63B 60/00* (2015.01)

(52) U.S. Cl.
CPC ..... *A63B 53/0466* (2013.01); *A63B 53/04* (2013.01); *A63B 2053/045* (2013.01);
(Continued)

(58) Field of Classification Search
CPC ..... A63B 53/04; A63B 53/0466; A63B 2053/0408; A63B 2053/0416;
(Continued)

(56) References Cited

U.S. PATENT DOCUMENTS 1,671,956 A 5/1928 Sime
2,087,685 A 7/1937 Hackney
(Continued)

FOREIGN PATENT DOCUMENTS

GB 2321201 7/1998
JP 05212139 8/1993
(Continued)

OTHER PUBLICATIONS

Photos of Taylormade Burner 2007 Driver, Callaway FT-5 Driver, Callaway FTi Driver, Cobra L4V Cross-section Driver, Cobra Speed LD Driver, Nike SQ Driver, PING Rapture Driver, Taylormade R7 425 Driver, Taylormade R7 460 Driver, Taylormade R7 Superquad Driver, Titleist 905S Driver, and Titleist907 D2 Driver, 6 pp., all prior to Oct. 27, 2009.

*Primary Examiner* — Stephen Blau
(74) *Attorney, Agent, or Firm* — Klarquist Sparkman, LLP

(57) ABSTRACT

A golf club head is described having a body defining an interior cavity and comprising a heel portion, a toe portion, and a sole portion positioned at a bottom portion of the golf club head, and a crown positioned at a top portion. The body has a forward portion and a rearward portion. A face is positioned at the forward portion of the body. The face has a center face location and includes a center face characteristic time. An off-center location on the face is located at about −40 mm in a heel direction away from the center face location. The off-center location has an off-center characteristic time of at least 80% of the center face characteristic time.

31 Claims, 10 Drawing Sheets

(52) U.S. Cl.
CPC ..... *A63B 2053/0408* (2013.01); *A63B 2053/0412* (2013.01); *A63B 2053/0416* (2013.01); *A63B 2053/0454* (2013.01); *A63B 2053/0458* (2013.01); *A63B 2053/0462* (2013.01); *A63B 2053/0491* (2013.01); *A63B 2060/002* (2015.10); *A63B 2209/00* (2013.01)

(58) Field of Classification Search
CPC .... A63B 2053/0462; A63B 2053/0454; A63B 2060/002; A63B 2209/00; A63B 2053/045; A63B 2053/0412; A63B 2053/0491; A63B 2053/0458
See application file for complete search history.

(56) References Cited

U.S. PATENT DOCUMENTS 3,233,905 A 2/1966 Flom
4,432,549 A 2/1984 Zebelean
4,826,172 A 5/1989 Antonious
4,928,965 A 5/1990 Yamaguchi et al.
5,028,049 A 7/1991 McKeighen
5,076,585 A 12/1991 Bouquet
5,362,047 A 11/1994 Shaw et al.
5,451,056 A 9/1995 Manning
5,465,970 A 11/1995 Adams et al.
5,595,552 A 1/1997 Wright et al.
5,626,530 A 5/1997 Schmidt et al.
5,643,108 A 7/1997 Cheng
5,707,302 A 1/1998 Leon et al.
5,766,094 A 6/1998 Mahaffey et al.
5,776,011 A 7/1998 Su et al.
5,830,084 A 11/1998 Kosmatka
5,851,160 A 12/1998 Rugge et al.
5,873,795 A 2/1999 Wozny et al.
5,921,869 A 7/1999 Blough et al.
5,971,868 A 10/1999 Kosmatka
5,993,331 A 11/1999 Shieh
6,010,411 A 1/2000 Reyes
6,074,309 A 6/2000 Mahaffey
6,224,494 B1 5/2001 Patsky
6,248,025 B1 6/2001 Murphy et al.
6,290,609 B1 9/2001 Takeda
6,319,150 B1 * 11/2001 Werner ..... A63B 53/04 473/324
6,348,015 B1 2/2002 Kosmatka
6,379,262 B1 4/2002 Boone
6,413,169 B1 7/2002 Kosmatka
6,428,425 B1 8/2002 Naruo et al.
6,488,594 B1 12/2002 Card et al.
6,558,272 B2 * 5/2003 Helmstetter ..... A63B 53/04 473/329
6,605,007 B1 * 8/2003 Bissonnette ..... A63B 53/0466 473/329
6,612,938 B2 9/2003 Murphy et al.
6,652,391 B1 * 11/2003 Kubica ..... A63B 53/02 473/345
6,719,644 B2 * 4/2004 Beach ..... A63B 53/04 473/330
6,773,360 B2 8/2004 Willett et al.
6,780,124 B2 8/2004 Lu
6,800,038 B2 * 10/2004 Willett ..... A63B 53/04 473/329
6,800,039 B1 10/2004 Tseng
6,821,214 B2 11/2004 Rice
6,824,475 B2 11/2004 Burnett et al.
6,899,638 B2 5/2005 Iwata et al.
6,904,663 B2 6/2005 Willett et al.
6,926,618 B2 8/2005 Sanchez et al.
6,991,558 B2 1/2006 Beach et al.
6,997,820 B2 2/2006 Willett et al.
7,018,303 B2 3/2006 Yamamoto
7,025,692 B2 4/2006 Erickson et al.
7,029,403 B2 4/2006 Rice et al.
7,066,832 B2 6/2006 Willett et al.
7,097,573 B2 8/2006 Erickson et al.
7,101,289 B2 9/2006 Gibbs et al.
7,131,912 B1 11/2006 Knuth
7,137,907 B2 11/2006 Gibbs et al.
7,140,974 B2 11/2006 Chao et al.
7,147,572 B2 12/2006 Kohno
7,166,040 B2 1/2007 Hoffman et al.
7,166,207 B2 1/2007 Chao et al.
7,186,190 B1 3/2007 Beach et al.
7,192,364 B2 3/2007 Long
7,258,626 B2 8/2007 Gibbs et al.
7,261,643 B2 8/2007 Rice et al.
7,267,620 B2 9/2007 Chao et al.
7,331,877 B2 2/2008 Yamaguchi et al.
7,361,099 B2 4/2008 Rice et al.
7,384,348 B2 6/2008 Lin et al.
7,407,447 B2 8/2008 Beach et al.
7,419,441 B2 9/2008 Hoffman et al.
7,442,132 B2 10/2008 Nishio
7,527,565 B1 5/2009 Ehlers et al.
7,549,934 B2 6/2009 Rice
7,575,524 B2 8/2009 Willett et al.
7,575,525 B2 8/2009 Matsunaga et al.
7,585,233 B2 * 9/2009 Horacek ..... A63B 53/0466 473/345
7,591,736 B2 * 9/2009 Ban ..... A63B 53/0466 473/329
7,682,262 B2 3/2010 Soracco et al.
7,704,162 B2 * 4/2010 Rice ..... A63B 53/0466 473/329
7,785,213 B2 8/2010 Matsunaga et al.
7,798,916 B2 9/2010 Matsunaga et al.
7,883,431 B2 2/2011 Matsunaga et al.
9,199,138 B2 * 12/2015 Willett ..... A63B 53/0466
2002/0065146 A1 5/2002 Kusumoto
2003/0036442 A1 2/2003 Chao et al.
2005/0059508 A1 3/2005 Burnett et al.
2005/0181884 A1 8/2005 Beach et al.
2006/0079347 A1 4/2006 Gibbs et al.
2006/0079348 A1 * 4/2006 Murphy ..... A63B 53/0466 473/345
2006/0252576 A1 11/2006 Lo
2008/0132356 A1 6/2008 Chao et al.
2008/0139334 A1 * 6/2008 Willett ..... A63B 53/0466 473/329
2008/0146374 A1 6/2008 Beach et al.
2008/0149267 A1 6/2008 Chao
2008/0254911 A1 10/2008 Beach et al.
2008/0300068 A1 12/2008 Chao
2009/0005191 A1 1/2009 Lin
2009/0163289 A1 6/2009 Chao
2009/0163291 A1 6/2009 Chao
2009/0163292 A1 6/2009 Chao
2009/0227389 A1 9/2009 Meyer et al.
2009/0264218 A1 10/2009 Willett et al.

FOREIGN PATENT DOCUMENTS

JP 06182005 7/1994
JP 06218083 8/1994
JP 07163687 6/1995
JP 08155060 6/1996
JP 08243194 9/1996
JP 8280853 10/1996
JP 08308967 11/1996
JP 2651565 5/1997
JP 09239074 9/1997
JP 09253243 9/1997
JP 09299519 11/1997
JP 11042300 2/1999
JP 11216204 8/1999
JP 11235406 8/1999
JP 2000126340 5/2000
JP 2001252379 9/2001
JP 2002-017912 1/2002
JP 2002000777 1/2002
JP 2002136626 5/2002

(56) References Cited

FOREIGN PATENT DOCUMENTS

| | | |
|---|---|---|
| JP | 2002143350 | 5/2002 |
| JP | 2002165904 | 6/2002 |
| JP | 2003102879 | 4/2003 |
| JP | 2003210622 | 7/2003 |
| JP | 2003310807 | 11/2003 |
| JP | 2004097550 | 4/2004 |
| JP | 2004129943 | 4/2004 |
| JP | 2004129944 | 4/2004 |
| JP | 2004135990 | 5/2004 |
| JP | 2004208728 | 7/2004 |
| JP | 2004267630 | 9/2004 |
| JP | 2004298478 | 10/2004 |
| JP | 2006166975 | 6/2006 |
| JP | 2006167279 | 6/2006 |
| JP | 2006263162 | 10/2006 |
| JP | 2007082752 | 4/2007 |
| JP | 2007313330 | 12/2007 |

* cited by examiner

GOLF CLUB HEAD

CROSS REFERENCE TO RELATED APPLICATION

This application is a continuation of U.S. patent application Ser. No. 12/589,804, filed Oct. 27, 2009, which is incorporated herein by reference.

BACKGROUND OF THE INVENTION

Golf is a game in which a player, using many types of clubs, hits a ball into each hole on a golf course in the lowest possible number of strokes. Golf club head manufacturers and designers seek to improve certain performance characteristics such as forgiveness, playability, feel, and sound. In addition, the aesthetic of the golf club head must be maintained while the performance characteristics are enhanced.

In general, "forgiveness" is defined as the ability of a golf club head to compensate for mis-hits where the golf club head strikes a golf ball outside of the ideal contact location. Furthermore, "playability" can be defined as the ease in which a golfer can use the golf club head for producing accurate golf shots. Moreover, "feel" is generally defined as the sensation a golfer feels through the golf club upon impact, such as a vibration transferring from the golf club to the golfer's hands. The "sound" of the golf club is also important to monitor because certain impact sound frequencies are undesirable to the golfer.

Golf head forgiveness can be directly measured by the moments of inertia of the golf club head. A moment of inertia is the measure of a golf head's resistance to twisting upon impact with a golf ball. Generally, a high moment of inertia value for a golf club head will translate to a lower amount of twisting in the golf club head during "off-center" hits. Because the amount of twisting in the golf club head is reduced, the likelihood of producing a straight golf shot has increased thereby increasing forgiveness. In addition, a higher moment of inertia can increase the ball speed upon impact thereby producing a longer golf shot.

The United States Golf Association (USGA) regulations constrain golf club head shapes, sizes, and moments of inertia. Due to theses constraints, golf club manufacturers and designers struggle to produce a club having maximum size and moment of inertia characteristics while maintaining all other golf club head characteristics.

SUMMARY OF THE DESCRIPTION

In one embodiment, the present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures According to one aspect of the present invention, a golf club head is described having a body defining an interior cavity and comprising a heel portion, a toe portion, and a sole portion positioned at a bottom portion of the golf club head, and a crown positioned at a top portion. The body has a forward portion and a rearward portion. A face is positioned at the forward portion of the body. The face has a center face location and includes a center face characteristic time. An off-center location on the face is located at about −40 mm in a heel direction away from the center face location. The off-center location has an off-center characteristic time of at least 80% of the center face characteristic time.

In one example, the center face characteristic time is between about 230 μs and about 257 μs. In another example, the off-center characteristic time is greater than 190 μs or 210 μs.

In one example, the body has a volume of between about 400 cc and about 500 cc. In another example, the moment of inertia about the center of gravity z-axis is greater than 450 kg·mm$^2$. In one example, the face includes a face area greater than 4,500 mm$^2$ or 5,000 mm$^2$.

In yet another example, the face includes a composite face insert. In one example, the golf club head has a head origin defined as a position on the face plane at the center face location. The head origin includes an x-axis tangential to the face and generally parallel to the ground when the head is in an address position where a positive x-axis extends towards the heel portion. A y-axis extends perpendicular to the x-axis and generally parallel to the ground when the head is in the address position where a positive y-axis extends from the face and through the rearward portion of the body. A z-axis extends perpendicular to the ground and to the x-axis and to the y-axis when the head is ideally positioned. A positive z-axis extends from the origin and generally upward. The golf club head has a center of gravity with a y-axis coordinate being greater than about 15 mm.

In one example, the golf club head center of gravity includes an x-axis coordinate between approximately −5 mm and approximately 10 mm. A y-axis coordinate is between approximately 15 mm and approximately 50 mm, and a z-axis coordinate is between approximately −10 mm and approximately 5 mm.

According to another aspect of the present invention, a golf club head includes an off-center location on the face located at about 40 mm in a toe direction away from the center face location, the off-center location having an off-center characteristic time being at least 80% of the center face characteristic time.

In one example, the off-center characteristic time is greater than 200 μs or greater than 220 μs.

According to another aspect of the present invention, a first off-center location on the face is located at about 40 mm in a toe direction away from the center face location. A second off-center location on the face is located at about −40 mm in a heel direction away from the center face location. The first off-center location and the second off-center location each have an off-center characteristic time being at least 80% of the center face characteristic time. In one example, the center face characteristic time is between about 230 μs and about 257 μs and the first off-center location characteristic time and the second off-center characteristic time each are greater than 190 μs. In one example, the first off-center location characteristic time and the second off-center characteristic time each are greater than 210 μs.

In yet another example, the face includes a face area greater than 4,500 mm$^2$ and at least one rib is attached to a portion of a rear surface of the face.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Embodiments of a golf club head providing desired center-of-gravity (hereinafter, "CG") properties and increased moments of inertia (hereinafter, "MOI") and specific characteristic time values are described herein. In some embodiments, the golf club head has an optimal shape for providing maximum golf shot forgiveness given a maximum head volume, a maximum head face area, and a maximum head depth according to desired values of these parameters, and allowing for other considerations such as the physical attachment of the golf club head to a golf club and golf club aesthetics.

Forgiveness on a golf shot is generally maximized by configuring the golf club head such that the CG of the golf club head is optimally located and the MOI of the golf club head is maximized.

In certain embodiments, the golf club head has a shape with dimensions at or near the golf club head dimensional constraints set by current USGA regulations. In such embodiments, the golf club head features fall within a predetermined golf head shape range that results in a desired CG location and increased MOI, and thus more forgiveness on off center hits than conventional golf club heads.

In the embodiments described herein, the "face size" or "striking surface area" is defined according to a specific procedure described herein. A front wall extended surface is first defined which is the external face surface that is extended outward (extrapolated) using the average bulge radius (heel-to-toe) and average roll radius (crown-to-sole). The bulge radius is calculated using five equidistant points of measurement fitted across a 2.5 inch segment along the x-axis (symmetric about the center point). The roll radius is calculated by three equidistant points fitted across a 1.5 inch segment along the y-axis (also symmetric about the center point).

The front wall extended surface is then offset by a distance of 0.5 mm towards the center of the head in a direction along an axis that is parallel to the face surface normal vector at the center of the face. The "face size" is defined as the area of the club head in the front portion that is within the region defined by the front wall extended surface offset. The center of the face is defined according to USGA "Procedure for Measuring the Flexibility of a Golf Clubhead", Revision 2.0, Mar. 25, 2005, which is hereby incorporated by reference in its entirety.

Figure 1:
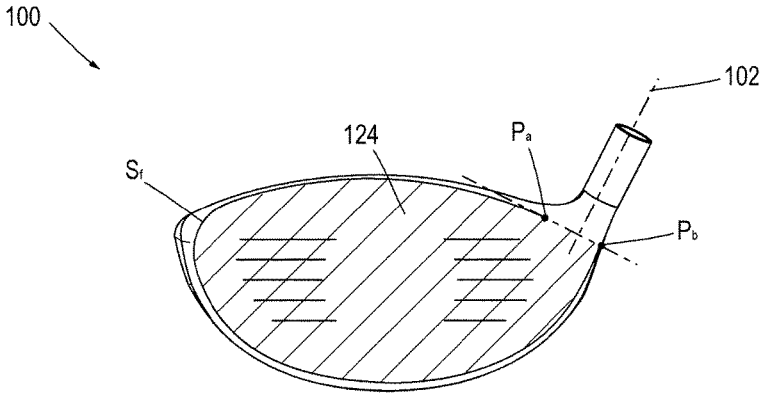
FIG. 1 illustrates a front view of a golf club head.

FIG. 1 illustrates a golf club head 100 and hosel axis 102. The golf club head 100 includes a face front wall profile shape curve (herein, "$S_f$") defined as the intersection of the external surface of the head with the offset extended front wall surface. Furthermore, the hosel region of the face front wall profile shape curve is trimmed by finding the intersection point (herein, "$P_a$") of $S_f$ with a 30 mm diameter cylindrical surface that is co-axial with the shaft (or hosel) axis. A line is drawn from the intersection point, $P_a$, in a direction normal to the hosel/shaft axis which intersects the curve $S_f$ at a second point (herein, "$P_b$"). The two points, $P_a$ and $P_b$, define two trimmed points of $S_f$. The line drawn from $P_a$ to $P_b$ defines the edge of the "face size" within the hosel region as defined in the present application.

Therefore, the "face size" (shown as the shaded region in FIG. 1) is a projected area normal to a front wall plane which is tangent to the face surface at the center of the face using the method defined in the USGA "Procedure for Measuring the Flexibility of a Golf Clubhead", Revision 2.0, Mar. 25, 2005.

Figure 2:
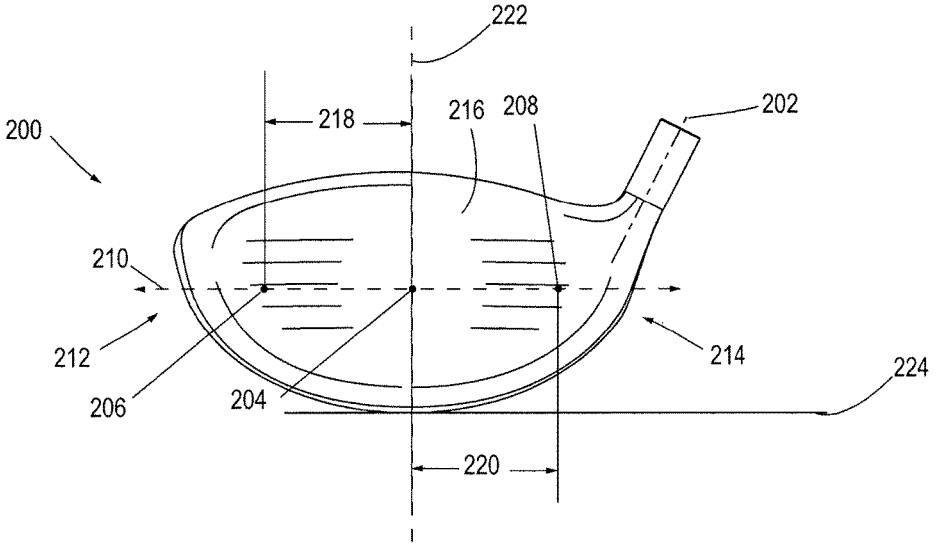
FIG. 2 illustrates a front view of a golf club head and first and second CT reference points.

FIG. 2 illustrates a golf club head 200 having a hosel axis 202 and a center face (hereinafter, "CF") location 204 on a face 216, as previously defined. A horizontal axis 210 extends from the center face location 204 towards a heel 214 direction (negative direction) and towards a toe 212 direction (positive direction). The horizontal axis 210 is generally tangent to the center face location 204 and parallel to a flat ground surface 224 at the address position. The horizontal axis 210 is referenced in determining a characteristic time (hereinafter, "CT") distribution across the face of the golf club head 200. In addition, a vertical axis 222 is also shown being perpendicular to the horizontal axis 210 and the ground surface 224.

In one exemplary embodiment, a first CT reference point 206 is shown on the surface of the face 216 in a toe 212 direction. The first CT reference point 206 is offset from the center face location 204 by a first offset distance 218 along the horizontal axis 210. The first CT reference point 206 is not offset along the vertical axis 222. Similarly, a second CT reference point 208 is shown on the surface of the face 216 in a heel direction. The second CT reference point 208 is offset from the center face location 204 by a second offset distance 220 along the horizontal axis 210. The first and second CT reference points 206,208 can be equidistant from the center face and offset by a distance between 0 mm and 60 mm in order to take CT measurements at multiple points across the surface of the face 216.

Figure 3:
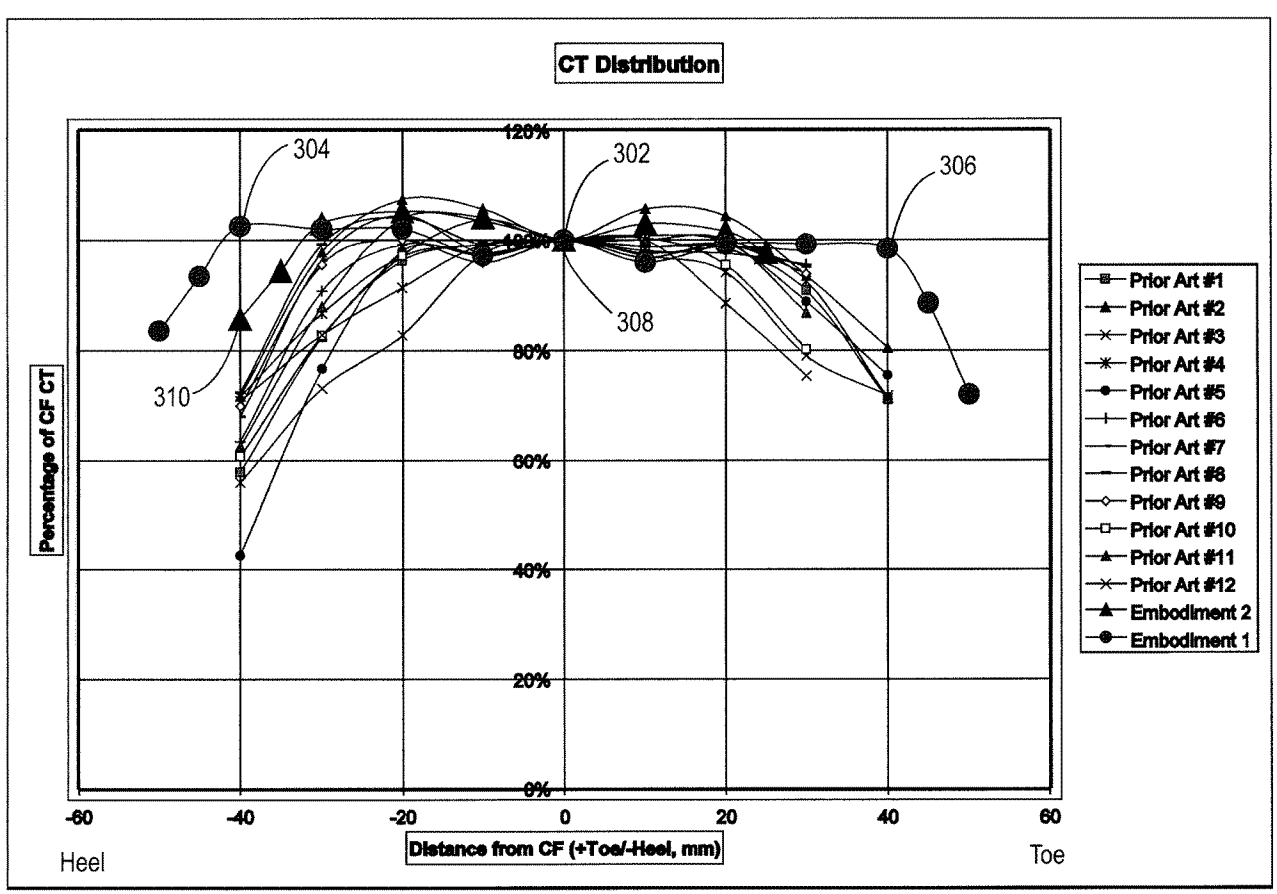
FIG. 3 illustrates a graph including a CT distribution of two embodiments compared to the prior art.

FIG. 3 illustrates a comparison chart 300 of CT characteristics of various prior art clubs with two exemplary embodiments. The x-axis in the comparison chart 300 of FIG. 3 indicates the location of a CT measurement point along the horizontal axis 210. The y-axis in the comparison chart 300 indicates the percentage of center face CT at any given CT reference point. For example, Embodiment 1 includes thirteen different measured CT reference points along the horizontal axis 210 in 5 mm or 10 mm increments from the center face location 302.

Furthermore, it should be noted that Embodiment 1 provides a relatively constant CT across the face from the heel-to-toe relative to the prior art clubs tested. A more consistent CT can promote a more consistent trajectory and distance upon impact. A first CT reference point 306 is located at an offset of 40 mm from the center face location 302 and a second CT reference point 304 is located at an offset of −40 mm from the center face location 302. In certain embodiments, the first and second CT reference points 306,304 at 40 mm and −40 mm from the center face each have a CT Value that deviates from the center face CT Value by 10% or less. In other words, the off-center characteristic time is at least 90% of the center face characteristic time.

In some embodiments, the first and second CT reference points 306,304 at 40 mm and −40 mm from the center face each deviate from the center face CT Value by between 0% and 5% or between 0% and 15%. The off-center characteristic time is at least 80% or 85% of the center face characteristic time and can be at least 95% of the center face characteristic time. In one embodiment, the body and face of Embodiment 1 is a metallic material or titanium alloy.

In certain embodiments, the first and second CT reference points 306,304 at 40 mm and −40 mm from the center face each have a CT Value that deviates from the center face CT Value by less than 15% or 20%.

In some embodiments, the center face characteristic time is between about 230 μs and about 257 μs. The off-center characteristic time at the 40 mm and −40 mm location is between about 180 μs and about 257 μs. In some embodiments, the off-center characteristic time is greater than about 190 μs or greater than about 210 μs.

Table 1 illustrates specific CT values for Embodiment 1. The corresponding Offset Distance from Center Face and Percentage of Center Face CT is also shown for each CT Value. As previously noted, the CT Values are below the CT maximum limits set forth by the USGA Rules of Golf.

TABLE 1

| Embodiment 1 CT Values | | |
|---|---|---|
| Offset Distance from CF (mm) (+toe-side, −heel-side) | CT Value (μs) at the Offset Distance | Percentage of CF CT (%) at the Offset Distance |
| 50 | 175 | 72 |
| 45 | 215 | 88 |
| 40 | 239 | 98 |
| 30 | 241 | 99 |
| 20 | 241 | 99 |
| 10 | 233 | 96 |
| 0 | 243 | 100 |
| −10 | 236 | 97 |
| −20 | 248 | 102 |

TABLE 1-continued

| Embodiment 1 CT Values | | |
|---|---|---|
| Offset Distance from CF (mm) (+toe-side, −heel-side) | CT Value (μs) at the Offset Distance | Percentage of CF CT (%) at the Offset Distance |
| −30 | 248 | 102 |
| −40 | 249 | 102 |
| −45 | 227 | 93 |
| −50 | 203 | 84 |

The CT Values in the present application were calculated based on the method outlined in the USGA "Procedure for Measuring the Flexibility of a Golf Clubhead", Revision 2.0, Mar. 25, 2005, incorporated by reference in its entirety. Specifically, the method described in the sections entitled "3. Summary of Method", "5. Testing Apparatus Set-up and Preparation", "6. Club Preparation and Mounting", and "7. Club Testing" are exemplary sections that are relevant. Specifically, the characteristic time is the time for the velocity to rise from 5% of a maximum velocity to 95% of the maximum velocity under the test set forth by the USGA as described above.

Embodiment 1 described above is a titanium alloy construction of a club head shown in FIGS. 4A-4H. The face area of Embodiment 1 is approximately 5,530 $mm^2$ according to the procedures set forth above. The CT values measured for Embodiment 1 at the first and second CT reference points (+/−40 mm) in Table 1 are both greater than about 200 μs or greater than about 220 μs. Due to the large face size of Embodiment 1, a large CT value can be sustained at the first and second CT reference points.

In another example, Embodiment 2 includes a composite face insert located on the face with a metallic body shown in FIGS. 5A-5C, 6A, 6B described in further detail below.

Embodiment 2 includes nine different measured CT reference points along the horizontal axis 210 in 5 mm to 10 mm increments.

Embodiment 2 provides a heel-side CT reference point 310 located at an offset of −40 mm (heel-side) from the center face location 308. In certain embodiments, the heel-side CT reference points 310 at −40 mm from the center face has a CT Value that deviates from the center face CT Value by less than 20%. In some embodiments, the heel-side CT reference points 310 at −40 mm from the center face deviates from the center face CT Value by between 0% and 20% or between 0% and 15%. In one example, the body of Embodiment 2 is a metallic material or titanium alloy while the face includes a composite insert having a variable thickness, described in further detail below. The face size of Embodiment 2 according to the measurement method previously described is about 6,978 $mm^2$ but in other embodiments can be about 4,500 $mm^2$ or greater.

In certain embodiments, heel-side CT reference point 310 at −40 mm from the center face deviates from the center face CT Value by less than 15

Figure 4A:
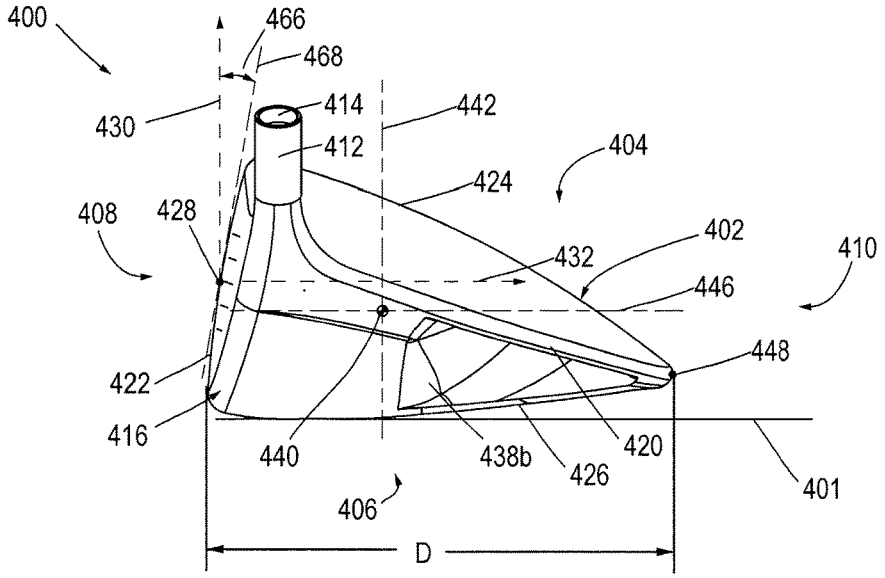
FIG. 4A illustrates a side view of a golf club head, according to one embodiment.

FIG. 4A shows a wood-type (e.g., driver or fairway wood) golf club head 400 including a hollow body 402 having a top portion 404, a bottom portion 406, a front portion 408, and a back portion 410. The club head 400 also includes a hosel 412 which defines a hosel bore 414 and is connected with the hollow body 402. The hollow body 402 further includes a heel portion 416 and a toe portion 418. A striking surface 422 is located on the front portion 408 of the golf club head 400. In some embodiments, the striking surface 422 can include a bulge and roll curvature and can be a face plate that is welded onto the front portion of the body. The striking surface 422 has a face plane 468 that forms a face angle 466.

In some embodiments of the present invention, the striking surface 422 is made of a composite material and includes a support structure and insert having dimensions and features as described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/823,638, 12/004,387, 11/960,609, 11/960,610 and Ser. No. 12/156,947, which are incorporated herein by reference in their entirety. The composite material can be manufactured according to the methods described in U.S. patent application Ser. No. 11/825,138.

In other embodiments, the striking surface 422 is made from a metal alloy (e.g., titanium, steel, aluminum, and/or magnesium), ceramic material, or a combination of composite, metal alloy, and/or ceramic materials. Moreover, the striking face 422 can be a striking plate having a variable thickness as described in U.S. Pat. Nos. 6,997,820, 6,800,038, and 6,824,475, which are incorporated herein by reference in their entirety.

The golf club head 400 also has a body volume, typically measured in cubic centimeters ($cm^3$), equal to the volumetric displacement of the club head 400, according to the United States Golf Association "Procedure for Measuring the Club Head Size of Wood Clubs" Revision 1.0 procedures. The embodiments described herein have a total body volume of between about 400 cc and about 500 cc. For example, the total body volume can be between about 450 cc and about 475 cc. In one example, the total body volume of Embodiment 1 and Embodiment 2 is about 460 cc.

A club head origin coordinate system is provided such that the location of various features of the club head (including, e.g., a club head CG) can be determined. In FIG. 4A, a club head origin point 428 is represented on the club head 400. The club head origin point 428 is positioned at the ideal impact location which is the center of the striking surface 422.

The head origin coordinate system is defined with respect to the head origin point 428 and includes a Z-axis 430, an X-axis 434 (shown in other views), and a Y-axis 432. The Z-axis 430 extends through the head origin point 428 in a generally vertical direction relative the ground 401 when the club head 400 is at an address position. Furthermore, the Z-axis 430 extends in a positive direction from the origin point 428 toward the top portion 404 of the golf club head 400.

The X-axis 434 extends through the head origin point 428 in a toe-to-heel direction substantially parallel or tangential to the striking surface 422 at the ideal impact location. The X-axis 430 extends in a positive direction from the origin point 428 to the heel 416 of the club head 400 and is perpendicular to the Z-axis 430 and Y-axis 432.

The Y-axis 432 extends through the head origin point 428 in a front-to-back direction and is generally perpendicular to the X-axis 434 and Z-axis 430. The Y-axis 432 extends in a positive direction from the origin point 428 towards the rear portion or back portion 410 of the club head 400.

The top portion 404 includes a crown 424 that extends substantially in an X-direction and Y-direction and has a top portion volume defined by the top portion 404. Similarly, the bottom portion 406 has a bottom portion volume. The bottom portion 406 also includes a sole area 426 that substantially faces the ground 401 at the address position of the golf club head 400 and also extends primarily in an X and Y-direction.

The top portion volume and the bottom portion volume are combined to create a total body volume. It is understood that the top 404 and bottom 406 portions are three dimensional objects that also extend in the Z-direction 430.

Moreover, the crown 424 is defined as an upper portion of the club head 400 above a peripheral outline of the club head 400 as viewed from a top-down direction and includes a region rearwards of the top most portion of the front portion 408 that contains the ball striking surface 422. In one embodiment, a skirt region can be located on a side portion 420 of the club head 400 and can include regions within both the top portion 404 and bottom portion 406. In some embodiments, a skirt region is not present or pronounced.

The top 404 and bottom 406 portions can be integrally formed using techniques such as molding, cold forming, casting, and/or forging and the striking face can be attached to the crown, sole, and skirt (if any) through bonding, welding, or any known method of attachment. For example, a face plate can be attached to the body 400 as described in U.S. patent application Ser. No. 10/442,348 (now U.S. Pat. No. 7,267,620) and Ser. No. 10/831,496 (now U.S. Pat. No. 7,140,974), as previously mentioned above. The body 400 can be made from a metal alloy such as titanium, steel, aluminum, and or magnesium. Furthermore, the body 400 can be made from a composite material, ceramic material, or any combination thereof. The body 400 can have a thin-walled construction as described in U.S. patent application Ser. No. 11/067,475 (now issued U.S. Pat. No. 7,186,190) and Ser. No. 11/870,913 which are incorporated herein by reference in their entirety.

Figure 4B:
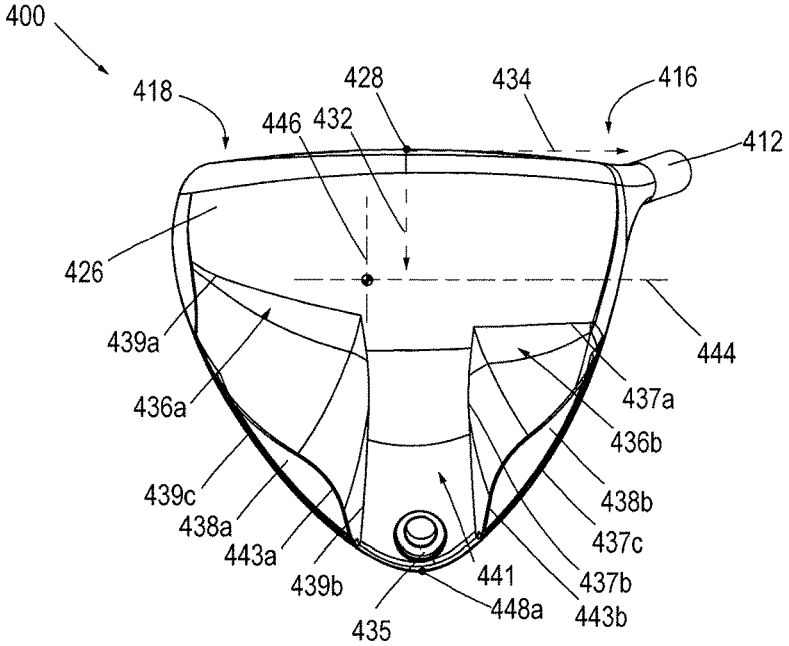
FIG. 4B illustrates a sole view of the golf club head in FIG. 4A.
Figure 4C:
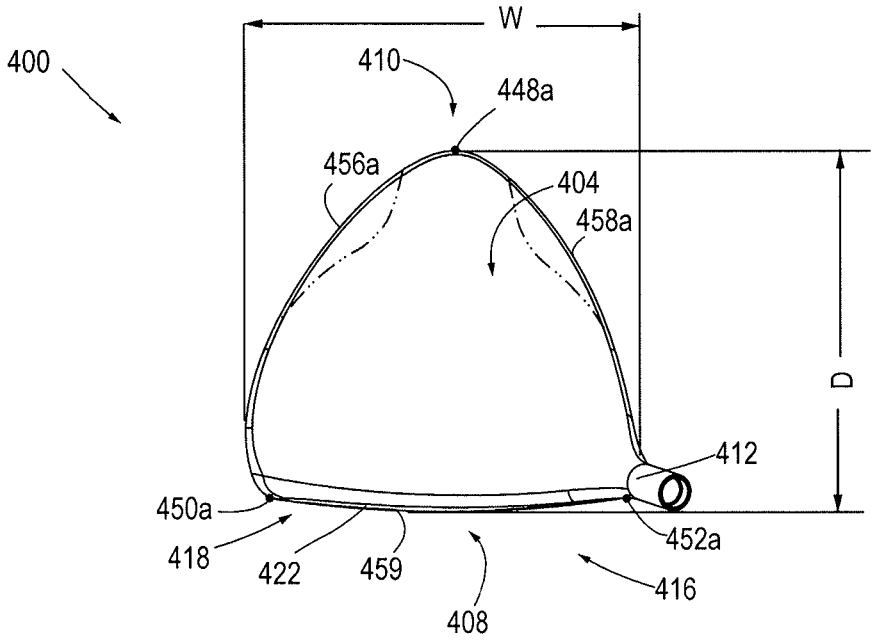
FIG. 4C illustrates a crown view of the golf club head in FIG. 4A.
Figure 4D:
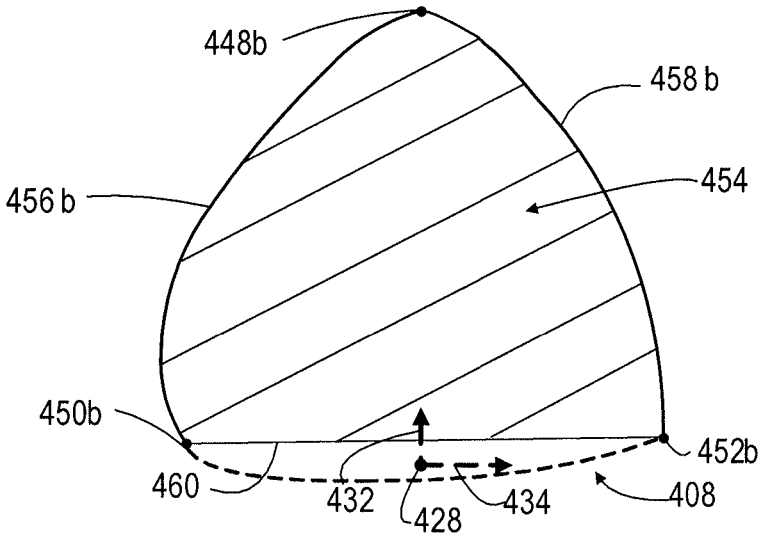
FIG. 4D illustrates a projected crown silhouette of the golf club head in FIG. 4C.
Figure 4E:
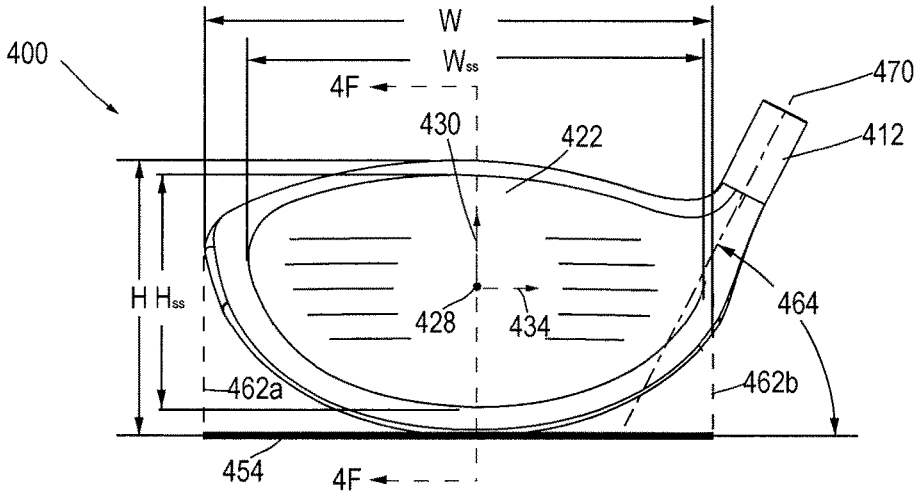
FIG. 4E illustrates a front view of the golf club head in FIG. 4A.

Referring to FIGS. 4A, 4C, and 4E, the golf club heads described herein each have a maximum club head height (H, top-bottom), width (W, heel-toe) and depth (D, front-back). The maximum height, H, is defined as the distance between the lowest and highest points on the outer surface of the golf club head body measured along an axis parallel to the origin Z-axis 430 when the club head is at a proper address position. The maximum depth, D, is defined as the distance between the forward-most and rearward-most points on the surface of the body measured along an axis parallel to the origin Y-axis 432 when the head is at a proper address position. The maximum width, W, is defined as the distance between the farthest distal toe point and closest proximal heel point on the surface of the body measured along an axis parallel to the origin X-axis 434 when the head is at a proper address position.

The height, H, width, W, and depth D of the club head in the embodiments herein are measured according to the United States Golf Association "Procedure for Measuring the Club Head Size of Wood Clubs" revision 1.0 and Rules of Golf, Appendix II(4)(b)(i).

Golf club head moments of inertia are defined about three axes extending through the golf club head CG 440 including: a CG z-axis 442 extending through the CG 440 in a generally vertical direction relative to the ground 401 when the club head 400 is at address position, a CG x-axis 444 extending through the CG 440 in a heel-to-toe direction generally parallel to the striking surface 422 and generally perpendicular to the CG z-axis 442, and a CG y-axis 446 extending through the CG 440 in a front-to-back direction and generally perpendicular to the CG x-axis 444 and the CG z-axis 442. The CG x-axis 444 and the CG y-axis 446 both extend in a generally horizontal direction relative to the ground 401 when the club head 400 is at the address position. Specific CG location values are discussed in further detail below with respect to certain exemplary embodiments.

The moment of inertia about the golf club head CG x-axis 444 is calculated by the following equation:

$$I_{CG_x}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CG x-axis 444 and the CG z-axis 442. The CG xy-plane is a plane defined by the CG x-axis 444 and the CG y-axis 446.

Moreover, a moment of inertia about the golf club head CG z-axis 442 is calculated by the following equation:

$$I_{CG_z}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis 446 and the CG z-axis 442. Specific moment of inertia values for certain exemplary embodiments are discussed further below.

FIG. 4B shows a bottom view of the bottom portion 406 having a first indentation 438*a* and a second indentation 438*b* located on the bottom portion 406 of the club head 400. The first indentation 438*a* is located near the toe portion 418 and the second indentation 438*b* is located near the heel portion 416 of the club head 400. In one exemplary embodiment, the first 438*a* and second 438*b* indentation are generally triangular in shape and arranged so that the sole 426 forms a T-shape. In one embodiment, the first 438*a* and second 438*b* indentation are mirrored across the Y-axis 432 and are about the same shape and size. In other embodiments, the first indentation 438*a* is slightly larger than the second 438*b* indentation.

The first indentation 438*a* has a first edge 439*a*, a second edge 439*b*, and a third edge 439*c*. The second indentation 438*b* also has a first edge 437*a*, a second edge 437*b*, and a third edge 437*c*. The first edges 439*a*, 437*a* of both indentations extend in an X and Y-direction and are generally curved with respect to the X-axis 434. The second edges 439*b*, 437*b* of both indentations extend primarily in a Y-direction and are generally curved with respect to the Y-axis 432. The third edge 439*c* of the first indentation 438*a* is a curved edge in the X-Y plane that generally follows a silhouette profile near the toe side 418 of the club head 400. The third edge 437*c* of the second indentation 438*b* is also a curved edge in the X-Y plane that generally follows a silhouette profile near the heel side 416 of the club head 400.

In each indentation 438*a*, 438*b*, a convex indentation wall 436*a*, 436*b* extends from the first edge 439*a*, 437*a* toward the top portion 404 or crown 424 creating a fourth edge 443*a*, 443*b* located within the indentations 438*a*, 438*b*. The fourth edge 443*a*, 443*b* represents the intersection between the indentation wall 436*a*, 436*b* and a bottom surface of the crown 424. Thus, a bottom surface area of the crown 424 is exposed within each indentation 438*a*, 438*b* between the fourth edge 443*a*, 443*b* and the third edge 437*c*, 439*c*.

The convex indentation wall 436*a*, 436*b* ensures that the cavity of the club head 400 maintains a certain volume which can affect the sound frequency of the club head 400 upon direct impact with a golf ball. In one embodiment, the frequency of the sole upon direct impact with a golf ball has a first sole mode greater than 3000 Hz. In one exemplary embodiment, the first sole mode frequency is about 3212 Hz while the second and third modes are about 3297 Hz and 3427 Hz, respectively. In certain preferred embodiments, the first sole mode frequency is at between about 3200 to 3500 Hz.

The first 438*a* and second 438*b* indentations are separated by a plateau or center sole portion 441 that extends in a direction parallel to the Y-axis 432. In one exemplary embodiment, the width (along the X-axis 434) of the center sole portion 441 is about 22 mm to about 31 mm between the two indentations 438*a*, 438*b*. Furthermore, the width (along the X-axis 434) of each indentation 438*a*, 438*b* is about 50 mm to about 57 mm and the length (along the Y-axis 432) of each indentation 438*a*, 438*b* is about 69 mm or more than 60 mm. In another embodiment, the width of each indentation 438*a*, 438*b* is about 40 mm and the length of each indentation 438*a*, 438*b* is about 65 mm.

The center sole portion 441 also contains a movable weight port 435 located on the sole 426 near the back portion 410 where a movable weight may be inserted or removed to change characteristics of the CG location, as described in U.S. patent application Ser. No. 10/290,817 (U.S. Pat. No. 6,773,360), Ser. No. 10/785,692 (U.S. Pat. No. 7,166,040), Ser. Nos. 11/025,469, 11/067,475 (U.S. Pat. No. 7,186,190), Ser. No. 11/066,720 (U.S. Pat. No. 7,407,447), and Ser. No. 11/065,772 (U.S. Pat. No. 7,419,441), which are hereby incorporated by reference in their entirety.

The sole 426 of the bottom portion 406 is defined as a lower portion of the club head 400 extending upwards from a lowest point of the club head when the club head is positioned at a proper address position relative to a golf ball on a ground surface 401. In some exemplary embodiments, the sole 426 extends about 50-60% of the distance from the lowest point of the club head to the crown 424. In further exemplary embodiments, the sole extends upward in the Z-direction about 15 mm for a driver and between about 10 mm and 12 mm for a fairway wood. The sole 426 can include the entire bottom portion 406 or partially cover a bottom region of the bottom portion 406. The sole 426 and bottom portion 406 are located below the top portion 404 in a negative Z-direction.

FIG. 4C shows a top view of the club head 400 including the top portion 404, striking surface 422, and the hosel 412. The X-axis 434 and the Y-axis 432 extend from the origin point 428 as previously mentioned (not shown for clarity). A first point 448*a*, a second point 450*a*, and a third point 452*a* are located about the perimeter of the top portion 404. The first point 448*a* is a rearward-most point on the surface of the body measured along an axis parallel to the origin Y-axis 432 when the head 400 is at a proper address position. The second point 450*a* is an intersection point defining the intersection between the front portion 408, the top portion 404, and the bottom portion 406 that is located near the toe portion 418 of the club head 400. The third point 452*a* is an intersection point defining the intersection between the between the front portion 408, the top portion 404, and the bottom portion 406 that is located near the heel portion 416 of the club head 400. In one embodiment, the third point 452*a* defines an intersection that excludes or ignores a majority of the hosel 412.

A top portion silhouette profile includes a first contour 456*a*, a second contour 458*a*, and a third segment 459 being located along a perimeter of the top portion 404 defining the outer bounds of the top portion 404 in substantially an X-direction 434 and Y-direction 432.

The first contour 456*a* extends along an outer toe edge of the club head 400 between the first point 448*a* and second point 450*a*. The second contour 458*a* extends along an outer heel edge of the club head 400 between the first point 448*a* and third point 452*a*. The third segment 459 defining the top portion silhouette profile is a straight line (with respect to the X-axis 434 and Z-axis 430, i.e. viewed from the X-Z plane) along the surface of the front portion 408 or striking surface 422 that connects the second point 450*a* and the third point 452*a*. The first contour 456*a*, second contour 458*a*, and third segment 459 are substantially coplanar.

In certain embodiments, a plane between the top portion 404 and bottom portion 406 that contains the first point 448*a*, second point 450*a*, third point 452*a*, first contour 456*a*, second contour 458*a*, and third segment 459 can be referenced as a dividing plane for measuring a top portion volume and a bottom portion volume. In addition, the same dividing plane is used for measuring a top portion surface area $S_t$ or bottom portion surface area $S_b$. A top and bottom portion volume is measured according to the weighed water displacement method under United States Golf Association "Procedure for Measuring the Club Head Size of Wood Clubs" Revision 1.0 procedures.

FIG. 4D shows a projected crown silhouette 454 being the top portion silhouette profile shape that is externally projected on to the ground when looking vertically down at the crown 424 when the head 400 is in the address position.

The projected crown silhouette 454 occupies an area in the X-Y plane as emphasized by the hatched lines in FIG. 4D. However, the projected crown silhouette 454 excludes the striking surface 422 and front portion 408 as shown in dashed lines. The projected crown silhouette 454 is defined by the first point projection 448*b*, the second point projection 450*b*, the third point projection 452*b*, and a projected portion of the outer perimeter of the top portion 404 on to the ground 401 or an X-Y plane.

As further shown in FIG. 4D, the projected crown silhouette 454 is defined by three projected segments 456*b*, 458*b*, 460 located between the first 448*b*, second 450*b*, and third 452*b* projected points. The first contour 456*a* and the second contour 458*a* are located along the perimeter of the top portion 404 and correspond to the first projected segment 456*b* and the second projected segment 458*b*, respectively. The projected segments 456*b*, 458*b* are the projected profiles of the crown on to the X-Y plane or ground 401. The first projected segment 456*b* extends between the first projected point 448*b* and the second projected point 450*b*. The second projected segment 458*b* extends between the first projected point 448*b* and the third projected point 452*b*. The third segment 460 of the profile is a single line segment connecting the second projected point 450*b* and the third projected point 452*b* in the projected X-Y plane. Similar to the first 456*b* and second 458*b* projected segments, the third segment 460 corresponds to an actual crown top line profile contour and is a relatively straight-line boundary drawn between the second projected point 450*b* and third projected point 452*b* running along the top line of the face 422. In other words, the third segment 460 is a projected line of the boundary between the face 422 and the crown 424.

In one embodiment, the projected crown silhouette 454 occupies a projected silhouette area of about 11,702 $mm^2$ in an X-Y plane which excludes the face 422. In some embodiments, the projected silhouette area is greater than 10,000 $mm^2$. The volume saved in the bottom portion 406 is reallocated to the top portion 404 of the club head 400 to create a larger and more unique projected crown silhouette 454 or top portion perimeter shape.

FIG. 4E shows a front view of the club head 400 and striking surface 422 at an address position. Projection lines 462*a*, 462*b* are shown in dashed lines to further illustrate how the crown silhouette is projected on to the ground 401, as previously described. It is understood that the crown silhouette can be projected on to any X-Y plane, not necessarily the ground 401 only, without departing from the scope of the invention.

A golf club head, such as the club head 400 is at its proper address position when face angle 466 is approximately equal to the golf club head loft and the golf club head lie angle 464 is about equal to 60 degrees. In other words, the address position is generally defined as the position of the club head as it naturally sits on the ground 401 when the shaft is at 60 degrees to the ground.

The face angle 466 is defined between a face plane 468 that is tangent to an ideal impact location 428 on the striking surface 422 and a vertical Z-X plane containing the Z-axis 430 and X-axis 434. Moreover, the golf club head lie angle 464 is the angle between a longitudinal axis (or hosel axis) 470 of the hosel 412 or shaft and the ground 401 or X-Y plane. It is understood that the ground 401 is assumed to be a level plane.

FIG. 4E further shows the ideal impact location 428 on the striking surface 422 of the golf club head. In one embodiment, the origin point 428 or ideal impact location is located at the geometric center of the striking surface 422. The origin point 428 is the intersection of the midpoints of a striking surface height ($H_{ss}$) and striking surface width ($W_{ss}$) of the striking surface 422 as measured according to the USGA "Procedure for Measuring the Flexibility of a Golf Clubhead", Revision 2.0.

In certain embodiments, the ball striking surface 422 has the maximum allowable surface area under current USGA dimensional constraints for golf club heads in order to achieve a desired level of forgiveness and playability. Specifically, the maximum club head height (H) is about 71 mm (2.8") and a maximum width (W) of about 127 mm (5"). In certain embodiments, the height is about 63.5 mm to 71 mm (2.5" to 2.8") and the width is about 119.38 mm to about 127 mm (4.7" to 5.0"). Furthermore, the depth dimension (D) is about 111.76 mm to about 127 mm (4.4" to 5.0"). In one preferred specific exemplary embodiment, the club height, H, is about 70 mm and the club width is about 126 mm while the club length is about 125 mm.

In one embodiment, the striking surface 422 may reach the maximum height H and width W dimensions as a direct result of the removal of volume from the bottom portion 406. In certain embodiments, the striking surface 422 has a surface area between about 4,000 $mm^2$ and 7,000 $mm^2$ and, in certain preferred embodiments, the striking surface 422 is greater than 4,500 $mm^2$ or 5,000 $mm^2$. In other embodiments, the ball striking surface 422 may have a maximum height $H_{ss}$ value of about 67 mm to about 71 mm, a maximum width $W_{ss}$ value of about 418 mm to about 427 mm. In another exemplary embodiment, the striking surface 422 area is about 6,192 $mm^2$, according to the procedure for measuring striking surface area, as previously described.

The golf club head of the implementations shown herein can have a maximum depth D equal to the maximum allowable depth of about 127 mm (5 inches) under current USGA dimensional constraints. Because the moment of inertia of a golf club head about a CG of the head is proportional to the squared distance of a golf club head mass away from the CG, having a maximum depth D value can have a desirable effect on moment of inertia and the CG position of the club head. Thus, the presence of the indentation 438 achieves a large height H, depth D, and width W dimension of the club head 400 while maintaining an advantageous CG location and acceptable MOI values.

Specifically, in some implementations, the CG x-axis coordinate is between about −2 mm and about 7 mm, the CG y-axis coordinate is between about 30 mm and about 40 mm, and the CG z-axis coordinate is between about −7 mm and about 2 mm.

In other embodiments of the present invention, the golf club head 400 can have a CG with a CG x-axis 434 coordinate between about −5 mm and about 10 mm, a CG y-axis 432 coordinate between about 15 mm and about 50 mm, and a CG z-axis 430 coordinate between about −10 mm and about 5 mm. In yet another embodiment, the CG y-axis 432 coordinate is between about 20 mm and about 50 mm.

In one specific exemplary embodiment, the golf club head 400 has a CG with a CG x-axis 434 coordinate of about 2.8 mm, a CG y-axis 432 coordinate of about 31 mm, and a CG z-axis 430 coordinate of about −4.71 mm. In one example, a composite face embodiment can achieve a CG with a CG x-axis 434 coordinate of about 3.0 mm, a CG y-axis 432 coordinate of about 36.5 mm, and a CG z-axis 430 of about −6.0 mm.

In certain implementations, the club head 400 can have a moment of inertia about the CG z-axis, $I_{CGz}$, between about 450 kg·mm$^2$ and about 650 kg·mm$^2$, and a moment of inertia about the CG x-axis $I_{CGx}$ between about 300 kg·mm$^2$ and about 500 kg·mm$^2$. In one exemplary embodiment, the club head 400 has a moment of inertia about the CG z-axis, $I_{CGz}$, of about 504 kg·mm$^2$ and a moment of inertia about the CG x-axis $I_{CGz}$ of about 334 kg·mm$^2$. In another exemplary embodiment, the striking surface 422 is composed of a composite material previously described and has a moment of inertia about the CG z-axis, $I_{CGz}$, of about 543 kg·mm$^2$ and a moment of inertia about the CG x-axis $I_{CGz}$ of about 382 kg·mm$^2$. In one embodiment, the composite striking surface 422 decreases the total club weight by about 10 g.

In addition, the presence of the indentation 438 in the bottom portion 406 increases the bottom portion surface area $S_b$ located below the top portion silhouette profile 456*a*, 458*a*, 459. In certain implementations the club head can have a top portion surface area $S_t$ (which includes the face) of about 16,000 mm$^2$ to 18,000 mm$^2$ and a bottom portion surface area $S_b$ of about 18,000 mm$^2$ to about 22,000 mm$^2$. The surface area ratio $S_r$ of the top portion surface area $S_t$ to the bottom portion surface area $S_b$ is represented by the equation:

$$S_r = \frac{S_t}{S_b}$$

In certain embodiments, the surface ratio $S_r$ can range between about 0.70 to about 0.96, with a preferred range of less than 0.90 and less than 0.80. A lower surface area ratio $S_r$ indicates that the bottom portion has an increased surface area due to the indentations.

In one exemplary embodiment, the top portion 404 surface area $S_t$ is about 17,117 mm$^2$ and the bottom portion 406 surface area $S_b$ including the indentation 438 is about 21,809 mm$^2$ resulting in a total surface area of about 38,926 mm$^2$ and a surface ratio $S_r$ of about 0.78. The top portion 404 surface area $S_t$ can be greater than about 15,000 mm$^2$ and the bottom portion 406 surface area $S_b$ including the indentation 438 is greater than about 20,000 mm$^2$.

Figure 4F:
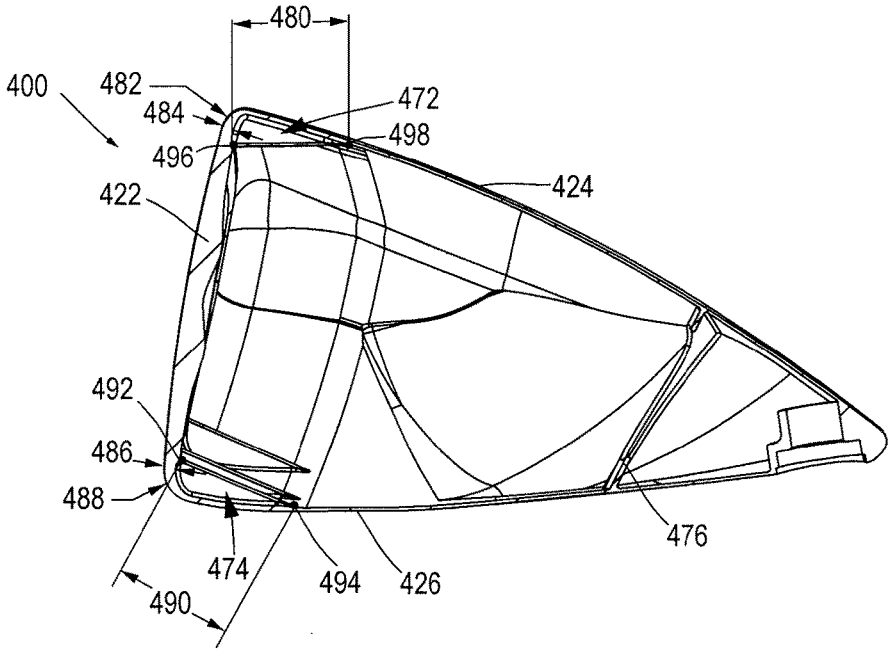
FIG. 4F illustrates a cross-sectional view taken along cross sectional lines 4F-4F shown in FIG. 4E.

FIG. 4F is a cross-sectional view taken along cross-sectional lines 4F-4F in FIG. 4E. The golf club head 400 includes upper ribs 472 and lower ribs 474. In one embodiment, the upper ribs 472 include three or more ribs spaced across the crown 424 to face 422 transition. In certain embodiments, the lower ribs include five or more ribs spaced across the sole 426 to face 422 transition. As shown, the face 422 is a variable face thickness as previously described. In addition, a rear rib 476 is shown extending across the interior crown 424 surface and interior sole 476 surface. Even though a large face size can increase the CT Values at the first and second CT reference points, the upper ribs 472 and lower ribs 474 are relied upon to prevent the CT Values from exceeding a desired CT Value maximum. The upper 472 and lower ribs 474 are strategically placed to increase the stiffness of the face in selected regions to lower the CT Values. Therefore, a face size greater than 4,500 mm$^2$ may require ribs described above to lower the CT Values to within acceptable limits.

FIG. 4F further shows a top 484 and bottom 486 face thickness immediately before the curvature of the transition region connecting the club head body and face 422. In some embodiments, the top 484 and bottom 486 face thickness measured perpendicularly to the face 422 is between 1 mm and 4 mm or less than 2.5 mm. The upper transition region radius 482 is between about 2 mm and 5 mm while the lower transition region radius 488 is between about 3 mm and 7 mm. In certain embodiments, the upper transition region radius 482 is less than the lower transition region radius 488. In one example, the upper rib 472 is attached to a portion of the face 422 at a first point 496 and the upper rib 472 is further attached at a second point 498 to a portion of the interior surface of the crown 424. In certain embodiments, the linear length 480 of the upper ribs 472 between the first point 496 and second point 498 is between about 5 mm and 30 mm or between about 15 mm and 25 mm.

Similarly, the lower ribs 474 include a first point 492 where the ribs connect with a portion of the face 422 and a second point 494 where the ribs connect with a portion of the interior surface of the sole 426. In certain embodiments, the linear length 490 of the lower ribs 474 between the first point 492 and the second point 494 is also between about 5 mm and 30 mm or between about 15 mm and 25 mm.

Figure 4G:
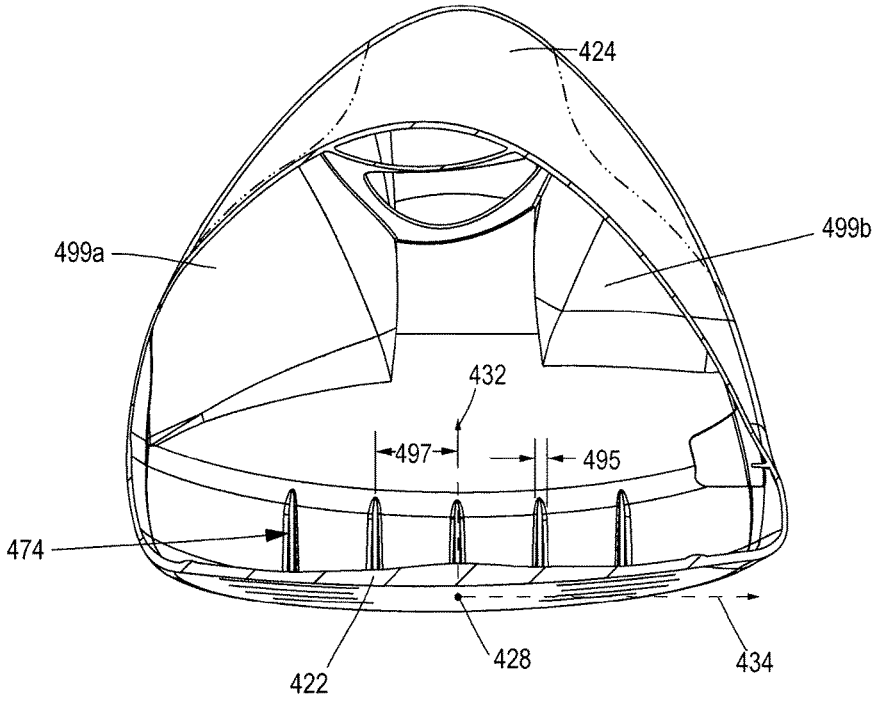
FIG. 4G illustrates a cross-sectional view taken through a crown portion of the golf club head in FIG. 4C.

FIG. 4G shows a cross-sectional view taken through the crown portion 424 and face 422 of the club head 400 showing an interior cavity and interior sole portion. The lower ribs 474 include five lower ribs being equally spaced and centered about the center point 428 as measured along the X-axis 434. The ribs can be spaced apart along the X-axis 434 by a distance of between about 5 mm to about 30 mm. In some embodiments, the ribs are spaced apart along the X-axis by a distance 497 of between about 15 mm and 25 mm. In addition, the interior cavity includes two interior raised portions 499*a*, 499*b* that correspond to the recesses 438*a*, 438*b* previously described. Each rib can have a thickness 495 of less than about 10 mm or less than about 5 mm. In one example, the rib is about 1 mm in thickness.

Figure 4H:
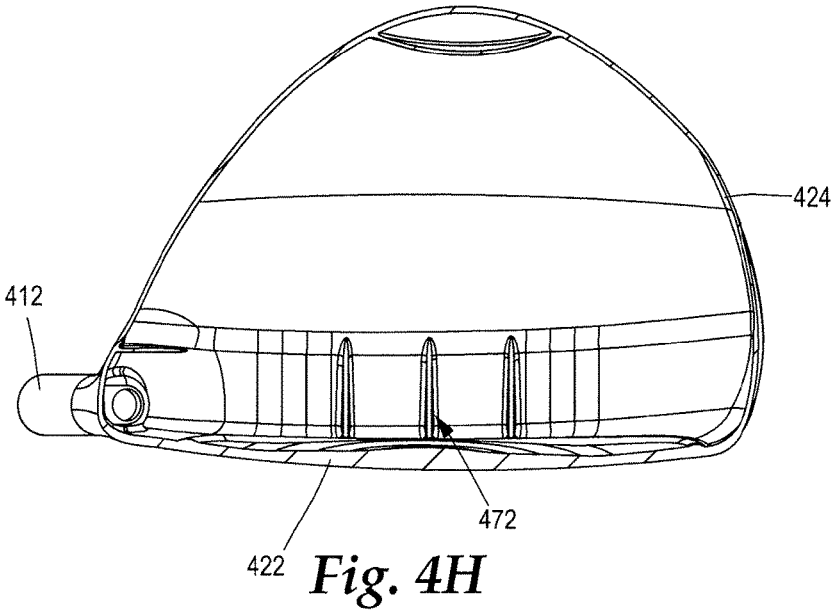
FIG. 4H illustrates a cross-sectional view taken through a crown portion of the golf club head in FIG. 4C showing an interior crown surface.

FIG. 4H shows a cross-sectional view taken through the crown portion 424 and face 422 showing an interior crown surface and three upper ribs 472. The upper ribs 472 have to be spaced apart according to the distances previously described and can include a thickness within the dimensions already described.

Figure 5A:
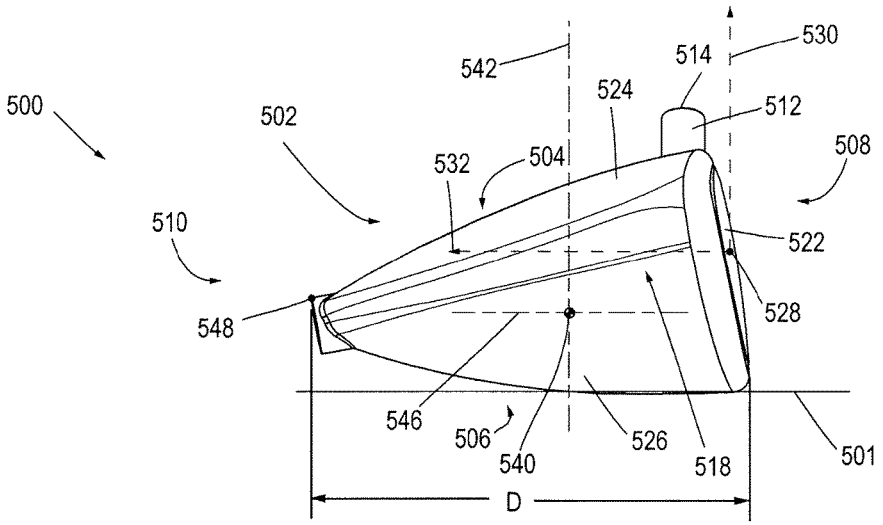
FIG. 5A illustrates a side view of a golf club head, according to another embodiment.

FIG. 5A shows a wood-type (e.g., driver or fairway wood) golf club head 500 including a hollow body 502 having a top portion 504, a bottom portion 506, a front portion 508, and a back portion 510 having a weight port 564. A hosel 512 which defines a hosel bore 514 is connected with the hollow body 502. The body 502 further includes a heel portion 516 and a toe portion 518.

FIG. 5A further shows a striking surface 522, a crown 524, a sole 526, an origin point 528, a Z-axis 530, a Y-axis 532, an X-axis 534, a rearward-most point 548 (at the address position), a CG point 540, a CG z-axis 542, a CG x-axis 544, a and a CG y-axis 546, as previously described. The club head 500 further includes a depth, D, as described above when positioned at the address position relative to the ground 501.

Figure 5B:
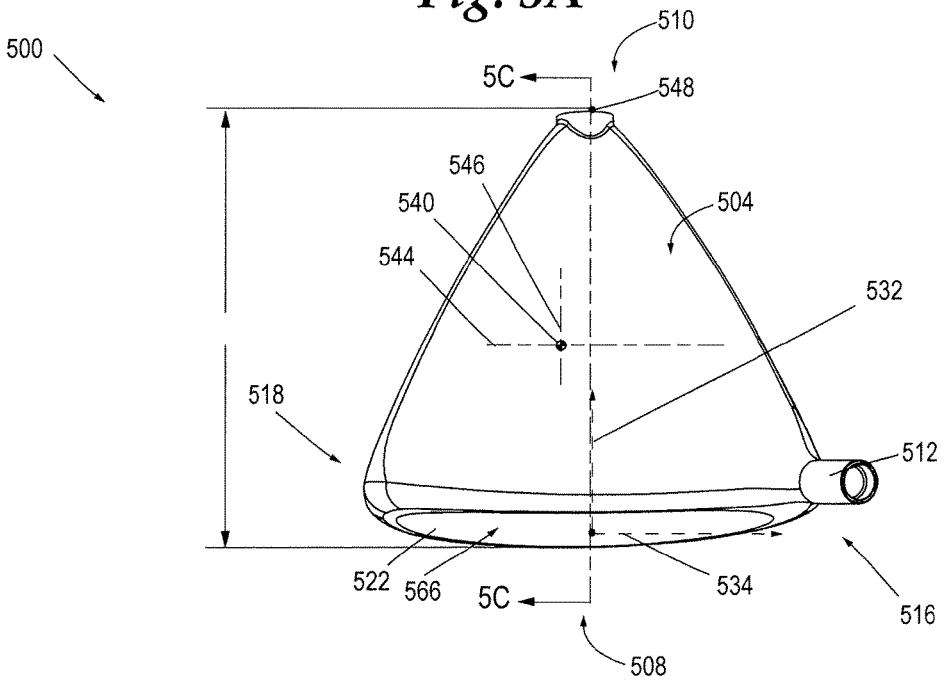
FIG. 5B illustrates a top view of the golf club head in FIG. 5A.

FIG. 5B shows a top view of the club head 500 including the top portion 504, striking surface 522, and the hosel 512. The X-axis 534 and the Y-axis 532 extend from the origin point 528 as previously mentioned.

Figure 5C:
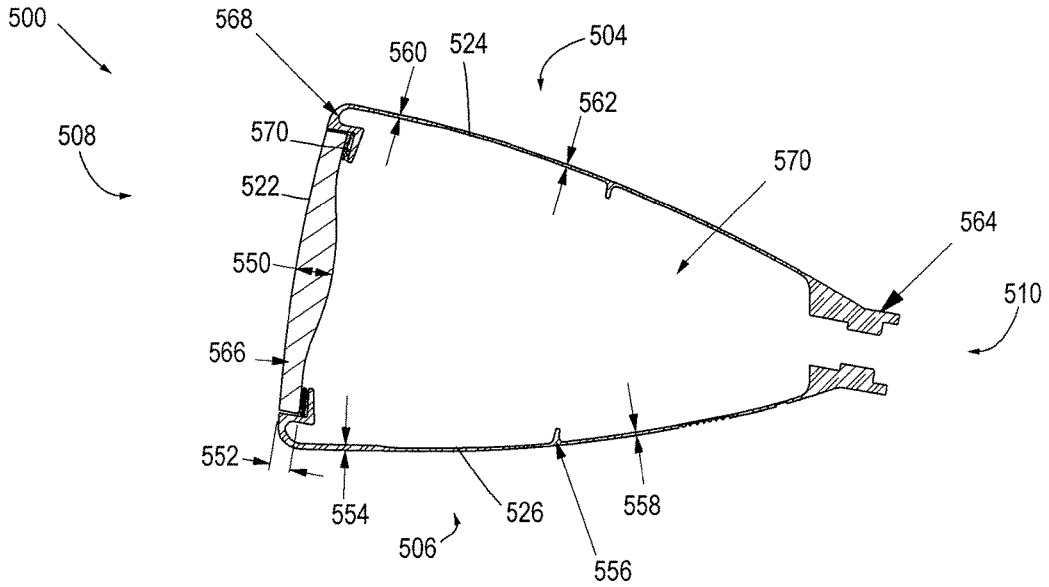
FIG. 5C illustrates a cross-sectional side view taken through cross-section lines 5C-5C in FIG. 5B.

FIG. 5C illustrates a cross-sectional view taken along cross-sectional lines 5C-5C in FIG. 5B. The striking surface 522 is primarily located on an insert 566. In one embodiment, the insert 566 is comprised of a composite material arranged to produce a variable thickness having a center thickness 550 greater than a peripheral end region thickness 552. In certain embodiments, the center thickness 550 is between about 2 mm and 10 mm or between about 4 mm and 9 mm. In some embodiments, the end region thickness 552 is between about 2 mm and about 8 mm or between about 3 mm and 6 mm. In one embodiment, the center face thickness is about 7.2 mm and the end region thickness 552 is about 4.1 mm.

The hinge region 568 is located about the edge of the insert 566 to support the peripheral end region of the insert 566. An adhesive 570 secures the insert 566 to the hinge region 568.

In some embodiments, a front crown thickness 560 and a back crown thickness 562 is located on the crown portion 524. In some embodiments, the front crown thickness 560 and the back crown thickness 562 is between about 0.5 mm to about 1 mm or about 0.6 mm or 0.8 mm. The front crown thickness 560 can be equal to or thicker than the back crown thickness 562.

In addition, a front sole thickness 554 and a back sole thickness 558 are located on the sole portion 526. In some embodiments, the front sole thickness 554 is between about 0.6 mm and 1.5 mm or about 1.1 mm. The back sole thickness 558 is between about 0.5 mm and about 1 mm. The front sole thickness 554 is greater than the back sole thickness 558. Furthermore, a continuous mid-section rib 556 can be provided on the interior surface of the club head cavity 570.

Figure 6A:
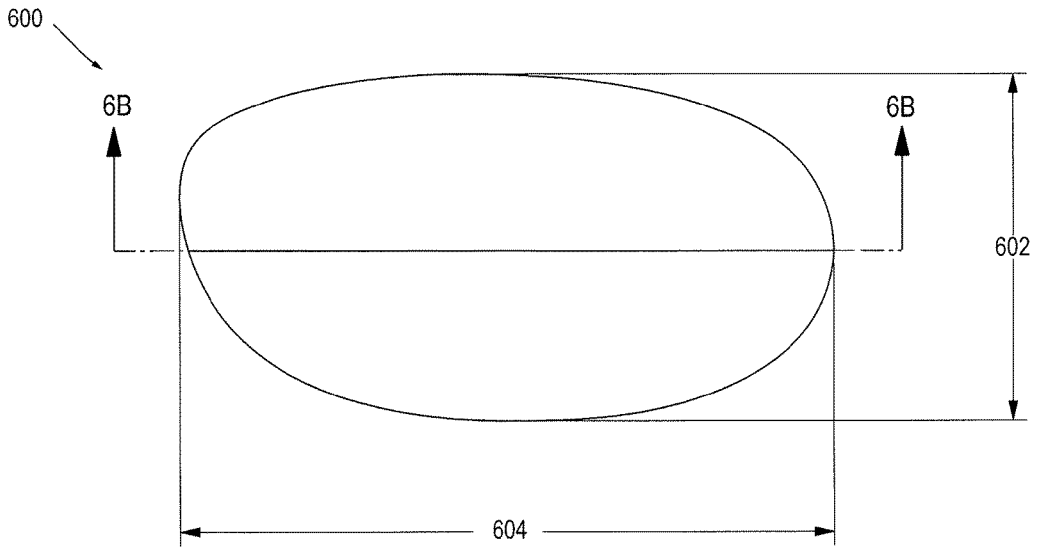
FIG. 6A illustrates a front view of a face insert.

FIG. 6A illustrates an exemplary composite insert 600 having a height dimension 602 and a width dimension 604. The height dimension 602 can be between about 50 mm and about 127 mm. The width dimension 604 can between about 100 mm and about 127 mm. In one embodiment, the height dimension 602 is about 57 mm and the width dimension is about 108 mm.

Figure 6B:
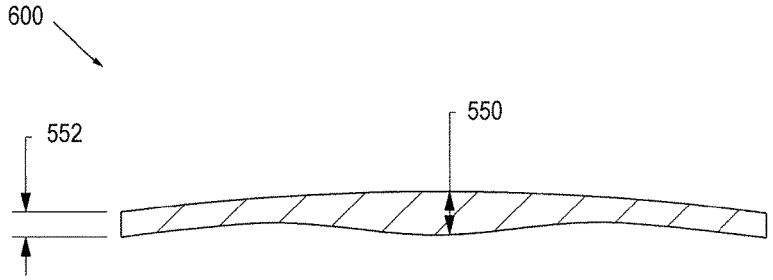
FIG. 6B illustrates a cross-sectional view taken through cross-section lines 6B-6B in FIG. 6A.

FIG. 6B illustrates a cross sectional view taken along cross section lines 6B-6B in FIG. 6A. The insert 600 includes a center thickness 550 and peripheral end region thickness 552 as previously described.

Figure 7A:
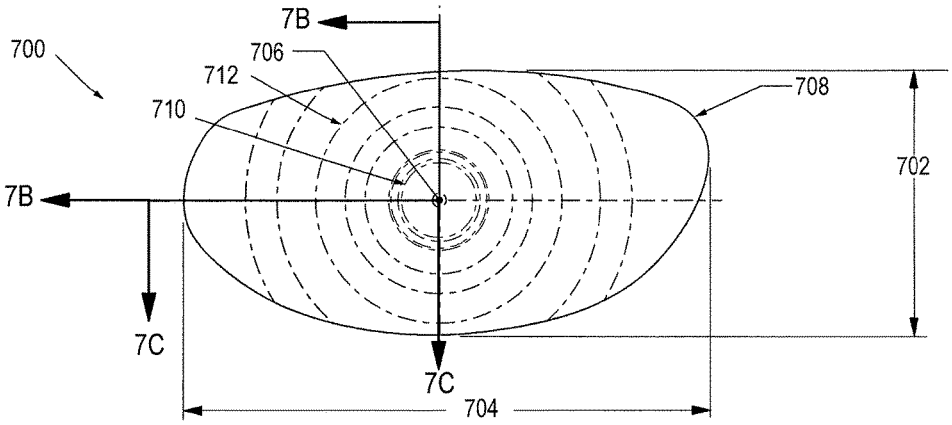
FIG. 7A illustrates a rear surface view of a face plate.

FIG. 7A shows a rear surface view of face plate 700 that is mechanically attached in the front portion of a club head to form a striking surface 422 (shown in FIG. 4F). The face plate 700 includes an outer profile 708, a center point 706, and inverted cone 710, a height dimension 702, and a width dimension 704. The face plate 700 includes varying thickness zones 712 surrounding the center point 706 and an inverted cone 710. The height dimension 702 is between about 50 mm and about 88 mm. In one embodiment, the height dimension 702 is about 54.0 mm. The width dimension 704 is between about 100 mm and about 127 mm. In one embodiment, the width dimension 704 is about 107 mm.

Figure 7B:
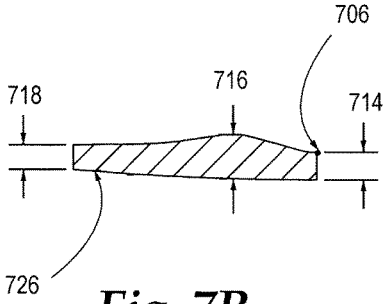
FIG. 7B illustrates a partial cross-sectional view taken through cross-section lines 7B-7B in FIG. 7A.

FIG. 7B is a partial vertical cross-sectional view taken along cross-section lines 7B-7B in FIG. 7A. FIG. 7B further shows a front striking surface 726, a center point thickness 714, an inverted cone maximum thickness 716, and a peripheral end thickness 718. In some embodiments, the center point 706 thickness 714 is between about 2.5 mm to 3.5 mm. In one embodiment, the center point 706 thickness 714 is about 3.0 mm. In certain embodiments, the inverted cone maximum thickness 716 is between about 3.5 mm to 5.0 mm or between about 4.5 mm and about 5.0 mm. In one embodiment, the inverted cone maximum thickness 716 is about 4.8 mm. In some embodiments, the peripheral end thickness 718 is between about 2.0 to about 3.0 mm in one embodiment, the peripheral end thickness 718 is about 2.7 mm.

Figure 7C:
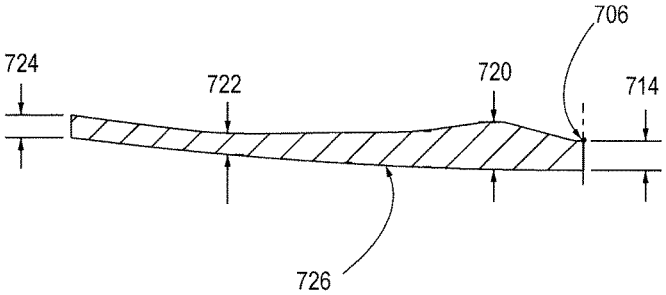
FIG. 7C illustrates a partial cross-sectional view taken through cross section liens 7C-7C in FIG. 7A.

FIG. 7C is a partial horizontal cross-sectional view taken along cross-section lines 7C-7C in FIG. 7A. FIG. 7C shows a center point 706 thickness 714, an inverted cone maximum thickness 720, a minimum thickness 722, and a peripheral end thickness 724. The inverted cone maximum thickness 720 is about the same dimensions as the inverted cone maximum thickness 716 previously described. The minimum thickness 722 is between about 2.0 mm to about 2.5 mm. In one embodiment, the minimum thickness 722 is about 2.1 mm and the peripheral end thickness 724 is about 2.3 mm. The peripheral end thickness 724 is greater than the minimum thickness 722.

In use, the embodiments of the present invention create a high CT Value when measured at 40 mm and −40 mm from the center face CT location on a large face while remaining within USGA limits. In one embodiment, the CT Value is consistent across the face of the club over a longer distance to promote a more consistent shot when the ball impacts an off-center location in either a heel or toe direction.

In addition, the embodiments described herein can also have various crown silhouette profile areas of greater than about 11,000 $mm^2$ and within the range of about 11,700 $mm^2$ to about 14,000 $mm^2$.

Furthermore, another advantage of the present invention, is that the club head still achieves a low CG (i.e. at least 2 mm below center-face and at least 15 mm aft of a hosel axis) in order to achieve a high launch angle, low spin trajectory for maximum distance. In one embodiment, the CG is at least 18 mm aft of a hosel axis. Another advantage of the present invention is that the moment of inertia about the vertical axis CG z-axis ($I_{CGz}$) is greater than about 500 $kg{\cdot}mm^2$ and the moment of inertia about the heel-toe axis CG x-axis ($I_{CGx}$) is greater than about 300 $kg{\cdot}mm^2$ plus a test tolerance of 10 $kg{\cdot}mm^2$.

Another advantage of the present invention is that a relatively high coefficient of restitution (COR) can be maintained. The COR measured in accordance with the U.S.G.A. Rule 4-1a is greater than 0.810 in the embodiments described herein.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

What is claimed is:

1. A golf club head having a more consistent trajectory and distance on impact comprising:

a heel portion;

a toe portion;

a crown;

a sole; and a face having a striking surface for striking a golf ball, the face having an ideal impact location at a center of the striking surface defining the origin of a coordinate system including a horizontal axis that extends substantially parallel to the face and generally parallel to the ground when the head is in an address position, with the negative direction of the horizontal axis pointing toward the heel portion and the positive direction of the horizontal axis pointing toward the toe portion, the face further having a first off-center location on the face located in a toe direction away from the center of the striking surface at 40 mm along the horizontal axis and a second off-center location on the face located in a heel direction away from the center of the striking surface at −40 mm along the horizontal axis, wherein a characteristic time at 10 mm increment locations on the face along the horizontal axis between the center of the striking surface and the second off-center location deviates from the characteristic time at the center of the striking surface by no more than 20%, wherein one or more ribs are positioned behind the face and extend across at least one of a crown-to-face transition and a sole-to-face transition to alter the stiffness of the striking surface thereby adjusting the characteristic time at various locations along the horizontal axis.

2. The golf club head of claim 1 wherein the one or more ribs are lower ribs.

3. The golf club head of claim 2 wherein the characteristic time at the center of the striking face is between 230 μs and 257 μs.

4. The golf club head of claim 1 wherein a characteristic time at each 10 mm spaced location on the face along the horizontal axis between the center of the striking face and −40 mm deviates from the characteristic time at the center of the striking face by no more than 10%.

5. The golf club head of claim 1 wherein a characteristic time at each 10 mm spaced location on the face along the horizontal axis between the center of the striking face and −40 mm deviates from the characteristic time at the center of the striking face by no more than 5%.

6. The golf club head of claim 1 wherein the center of the striking face is offset along the horizontal axis from a center of gravity of the golf club head.

7. The golf club head of claim 1 wherein the face size is greater than 4,500 $mm^2$.

8. The golf club head of claim 1 wherein the face size is greater than 5,500 $mm^2$.

9. The golf club head of claim 1 wherein the golf club head has a volume between 400 cc and 500 cc.

10. The golf club head of claim 9 wherein the golf club head has a volume between 450 cc and 475 cc.

11. The golf club head of claim 1 wherein the golf club head is configured to produce a frequency of greater than 3000 Hz when striking a golf ball.

12. The golf club head of claim 11 wherein the frequency is less than 3500 Hz.

13. The golf club head of claim 1 further having a surface ratio of between about 0.70 to 0.96.

14. The golf club head of claim 1 further having a surface ratio of between about 0.80 to 0.90.

15. The golf club head of claim 1 in which the face has a varying thickness.

16. The golf club head of claim 15 in which a thickest portion of the face surrounds the ideal impact location.

17. The golf club head of claim 15 in which a thickness profile of the face defines an inverted cone shape with a thickest portion surrounding the ideal impact location.

18. The golf club head of claim 1, wherein the one or more ribs comprise upper ribs spaced across the crown-to-face transition.

19. The golf club head of claim 1, wherein the one or more ribs comprise five or more lower ribs spaced across the sole-to-face transition.

20. The golf club head of claim 1, wherein the one or more ribs comprise three or more upper ribs spaced across a crown-to-face transition.

21. The golf club head of claim 1, wherein the one or more ribs comprise five or more lower ribs spaced across the sole-to-face transition and three or more upper ribs spaced across the crown-to-face transition.

22. The golf club head of claim 21, wherein the upper ribs and the lower ribs each have a linear length between about 5 mm and about 30 mm.

23. The golf club head of claim 21, wherein the upper ribs and the lower ribs each have a linear length between about 15 mm and about 25 mm.

24. The golf club head of claim 21, wherein the lower ribs are spaced apart a distance between about 5 mm and about 30 mm, and the upper ribs are spaced apart a distance between about 5 mm and about 30 mm.

25. The golf club head of claim 21, wherein the lower ribs are spaced apart a distance between about 15 mm and about 25 mm, and the upper ribs are spaced apart a distance between about 15 mm and about 25 mm.

26. A golf club head providing a more consistent trajectory and distance on impact resulting from a relatively constant characteristic time at locations along a horizontal axis passing through an ideal impact location centered on a striking surface of the club, the club head comprising:

a heel portion;

a toe portion;

a crown;

a sole; and a face comprising the striking surface, wherein the horizontal axis is generally parallel to the striking surface, the face further having a first off-center location on the face located in a toe direction away from the center of the striking surface at 40 mm and a second off-center location on the face located in a heel direction away from the center of the striking surface at −40 mm;

and the characteristic time at 10 mm spaced locations along the horizontal axis between the ideal impact location and the second off-center location deviates less than 10% from the characteristic time at the ideal impact location, wherein the ideal impact location is offset along the horizontal axis from a center of gravity for the club head, wherein one or more ribs are positioned behind the face and extend across at least one of a crown-to-face transition and a sole-to-face transition to alter the stiffness of the striking surface thereby adjusting the characteristic time at various locations along the horizontal axis; and wherein each rib is spaced between about 5 mm and 30 mm from adjacent ribs and having a thickness of less than about 10 mm.

27. The golf club head of claim 26 in which the face has a variable thickness comprising an inverted cone shape with its thickest portion surrounding the ideal impact location, the variable thickness adjusting the characteristic time at various locations along the horizontal axis.

28. The golf club head of claim 27 in which the face further includes a minimum thickness of the inverted cone shape and a peripheral end thickness, the peripheral end thickness being greater than the minimum thickness.

29. The golf club head of claim 28 in which the thickest portion has a thickness between about 2.5 mm and 5.0 mm, and the peripheral end thickness is between about 2.0 and 3.0 mm.

30. The golf club head of claim 26 in which the one or more ribs comprise a plurality of upper ribs spaced along the upper edge of the face.

31. The golf club head of claim 30 in which the one or more ribs comprise five lower ribs and three upper ribs.

* * * * *